United States Patent [19]

Moriya et al.

[11] Patent Number: 4,593,549

[45] Date of Patent: Jun. 10, 1986

[54] METHOD OF CONTROLLING A TENSION LEVELLING EQUIPMENT

[75] Inventors: Muneo Moriya; Toshihiro Takemasa; Keiichi Katayama, all of Hiroshima, Japan

[73] Assignee: Mitsubishi Jukogyo Kabushiki Kaisha, Tokyo, Japan

[21] Appl. No.: 753,625

[22] Filed: Jul. 10, 1985

[30] Foreign Application Priority Data

Jul. 10, 1984 [JP] Japan ..... 59-141417

[51] Int. Cl.[4] ..... B21B 37/00

[52] U.S. Cl. ..... 72/12; 72/160

[58] Field of Search ..... 72/11, 12, 21, 160, 72/161

[56] References Cited

U.S. PATENT DOCUMENTS

| | | | |
|---|---|---|---|
| 3,543,548 | 12/1970 | Smith | 72/11 |
| 4,011,743 | 3/1977 | Peterson | 72/12 |
| 4,232,369 | 11/1980 | Fukushime | 72/11 |
| 4,335,435 | 6/1982 | Miura | 72/12 |
| 4,400,957 | 8/1983 | Carlstedt | 72/12 |
| 4,539,830 | 9/1985 | Noe | 72/12 |
| 4,551,805 | 11/1985 | Shimode | 72/11 |

*Primary Examiner*—Leon Gilden

*Attorney, Agent, or Firm*—Birch, Stewart, Kolasch & Birch

[57] ABSTRACT

A method of controlling a tension levelling equipment for correcting residual distortions in an extension of strip including a series of input and output bridle roll means for rendering a tension upon the extension of strip extending between the input and output sides of a levelling mill station for smoothing out the distortions, and slipping clutch means connecting the bridle roll means with driving means allowing a slipping motion therebetween, which comprises the steps of measuring a current tension rendered upon the extension of strip at both the input and output sides of either of the input and output bridle roll means, and controlling the engaging torques of the slipping clutches in such a manner that a current slipping motion produced between the extension of strip and the bridle roll means may be nullified or eliminated according to the result of measurement of tensions, whereby it can remove all possible defects such as flaws and scratches in the surface of a strip product caused from the slipping motions as encountered during the passing through the tension leveler, thus contributing a substantial improvement in the surface condition and quality of the strip product.

2 Claims, 2 Drawing Figures

METHOD OF CONTROLLING A TENSION LEVELLING EQUIPMENT

BACKGROUND OF THE INVENTION (i) Field of the Invention

The present invention relates to the improvement in or relating to the method of controlling a tension levelling equipment or tension leveller for the correction of a deformation left in the rolled-down strip product such as a cold rolled steel strip, etc. (hereinafter referred to as "the strip product").

(ii) Description of the Prior Art

It is generally known that the rolled-down strip product suffers from such defects of distortion as a partial elongation and a partial bowing and warping, etc. caused from an evenness in the distribution of temperatures in the strip manufacturing process, a lack or reduction of accuracy of, and/or a lost proper adjustment in machines equipped in the strip mill. It is naturally inevitable that such defects of distortion would not only spoil the appearance of the sheet products, thus degrading the commercial value of the product, but also hampering the efficiency of feed throughout the procedures of roll-down operation on the strip product, and thus eventually rendering an obstackle to the automation operation of the entire strip production line. Also, this defect would then turn to be a further cause of distortions in the subsequent secondary working procedures. In this connection, there have been proposed the method of controlling a tension leveler in the attempt for the correction of such defects of distortion in the production of the strip product.

Referring first to FIG. 1, there is shown the general layout of a series of rolls and drive mechanisms as incorporated in the typical tension leveling equipment of conventional construction. As shown in this drawing figure, there are seen input bridle unit 3 and output bridle unit 4 provided on the input and output sides of a levelling mill 2, respectively, through which bridle units 3 and 4 an extension of strip 1 is fed under tension in the direction shown by arrows. By aid of a plurality of working rolls 5, 6, 7 which are arranged extending in a zigzag fashion above and below the extension of the strip 1 along the longitudinal direction of the entire levelling mill 2 of non-driven type, the strip 1 is subjected in sequence to the repeated procedures of bending throughout the whole extension of the levelling mill 2. With this sequence of procedures, the strip 1 is rendered a permanent elongation which is required for smoothing out its distortions, thus obtaining a due correction of distortions involved in the strip 1, accordingly. It is also seen that there is provided between the input and output bridle units 3 and 4 a drive mechanism which is operable with a due difference in feeding velocities set to be identical with a predetermined extent of elongation required on the strip 1.

It is designed for rendering a required rate of elongation on the extension of strip 1 that there is given a difference in velocities of rotation of the both input and output bridle units 3 and 4 which corresponds to a predetermined extent of elongation. More specifically, it is arranged that the both input and output bridle units 3 and 4 are connected mechanically to a single main motor 8, while a required difference in rotation velocities, that is a predetermined rate of elongation of the strip product is given by way of a stretching motor 9. In connection with this typical construction, it is known that a group of rolls in either of the both bride units 3 and 4, for instance, the group of rolls 4*a*, 4*b*, 4*c*, 4*d* of the output side bridle 4 is taken for a reference of rotating velocity, while the group of rolls 3*a*, 3*b*, 3*c*, 3*d* of the input side bridle unit 3 is for a lower velocity of rotation which is equal to a predetermined rate of elongation of the strip product 1. According to this construction illustrated, it is seen that the reference bridle unit 4 is driven directly by the main motor 8 through a set of bevel gears 10*b* and pinion stand 11*b*. On the other hand, the opposite side bridle unit 3 is operatively connected to a solar-revolutionary shaft 14 of a planetary gear 13 of a planetary gear unit 12 through a pinion stand 11*a* and a set of bevel gears 10*a*. It is also seen that a ring gear 15 is arranged to be driven by the main motor 8 through a pinion 16, while a solar gear 17 is driven by a stretching motor 9 which is, for instance, a direct current motor, respectively. This stretching motor 9 is equipped with a revolution speed control by a direct digital computer system, not shown. With this construction, a required difference in the peripheral velocities (that is, a predetermined rate of elongation) in the reference bridle unit 4 and the corresponding bridle unit 3 may precisely be controlled by way of the stretching motor 9. On the other hand, each roll in the group of rolls belonging to the both bridle units 3 and 4 is connected mechanically with each other so that it have the same number of revolution, respectively. However, on the part of the strip product 1, there occurs a slipping between these groups of rolls from an elongation as produced under the effect of tension rendered thereupon while passing these rolls, which slipping would possibly generate such damages as flaws or like scratches on the surface of the strip product 1. In an attempt to prevent such damages from occurring, there are provided in each of the bridle units 3, 4 a series of slipping clutches of, for instance, a powder clutch type or the like, P1, P2, P3, P4, P5, P6 between the groups of rolls 3*a*, 3*b*, 3*c* and 4*a*, 4*b*, 4*c* and the pinion stands 11*a*, 11*b*, as schematically shown in FIG. 1, so as to provide an appropriate cushioning or absorbing effect to such problem of slippings. In addition, there is provided a suitable tension meter TM3 in an appropriate position in line of the strip mill, for instance, between the output side of the levelling mill 2 and the output bridle unit 4 for measuring a tension T6 of the strip product 1. Then, thus-obtained result of measurement is converted to a measurement signal t3 corresponding thereto, and then is deliveryed to an arithmetic unit 18 so as to be processed to output signals tp1 through tp6, by which output signals the torque of each of slipping clutches is controlled accordingly so that a slipping between the strip product 1 and each of the groups of rolls may eventually be nullified.

According to this particular arrangement, it is noted that there is provided such a physical relationship between a torque of each clutch and a tension on the strip product 1 passing therethrough as shown in the following equations (1) through (3), and (6) through (8).

$$T_{qp1}=(T_2-T_1)\cdot D/2\cdot K \quad (1)$$

$$T_{qp2}=(T_3-T_{b\,2})\cdot D/2\cdot K \quad (2)$$

$$T_{qp3}=(T_4-T_3)\cdot D/2\cdot K \quad (3)$$

$$T_{q1}=(T_5-T_4)\cdot D/2\cdot K \quad (4)$$

$$T_{q2}=(T_6-T_7)\cdot D/2\cdot K \quad (5)$$

$$T_{qp4}=(T_7-T_8)\cdot D/2\cdot K \quad (6)$$

$$T_{qp5}=(T_8-T_9)\cdot D/2\cdot K \quad (7)$$

$$T_{qp6}=(T_9-T_{10})\cdot D/2\cdot K \quad (8)$$

where, $T_1 \sim T_{10}$ represents a value of tension on the strip product; TM3 represents a tension meter; $T_{qp1} \sim T_{qp6}$ represents a value of torque of a powder clutch; $T_{q1}$ and $T_{q2}$ represent torques of the reference bridle rolls 3*d* and 4*a* of the input and output bridle units; D represents a diameter of each roll; and K represents a ratio of reduction gears.

Recent years, however, the requirements for the improvement in the quality of the strip product have been growing more and more strict, and then a process of preventing flaws and scratches for the strip product by way of the mere provision of slipping clutches as provided between the strip product and the roll mechanism cannot meet such increasing requirements any longer.

Referring more specifically, according to the typical conventional method of preventing such defects of the strip product 1 as noted above, it is noted as reviewed fully hereinbefore that the torque of each of slipping clutches is controlled following the measurement signal t3 as given from the tension meter TM3, by the assumption that the current tension on a strip before and after the levelling mill 2 is $T_5=T_6$. However, it is to be noted that the current value of input tension $T_1$ at the input bridle 3 and the current value of output tension $T_{10}$ at the output bridle unit 4 are out of the range of control on the part of the tension levelling equipment, and also that the current value of tension will be $T_6=T_5+\alpha$ because of a bend loss (including a friction loss) in the strip product 1 when passing through the entire levelling mill 2, which would immediately means $T_5 \neq T_6$. As a consequence, it is not feasible in practice, as obvious from the equations (1) through (8) above, to attain any positive torque control taken fully in accordance of the actual fluctuations in tensions of the strip product 1, at all.

In consideration of such drawbacks particular to the conventional process for prevention of slipping in the levelling mill as noted above, it would be desirable to attain an efficient resolution for overcoming such inevitable problems particular to the conventional construction.

The present invention is essentially directed to the provision of a due and proper resolution to such inconveniences and difficulties in practice as outlined above and experienced in the conventional levelling mill of the strip product which have been left unattended with any proper countermeasures therefor.

SUMMARY OF THE INVENTION

The present invention is therefore materialized to practice in view of such circumstances and inconveniences as noted above. An object of the present invention is to provide an improved process of efficiently preventing any slipping motions as generated between the bridle rolls and the strip product while passing through a levelling equipment for correcting distortions existing in the strip product, whereby there is attainable a substantial improvement in the surface configuration and quality of the strip product, accordingly.

According to the above-mentioned object of the present invention, there is provided, as summarized, an improved process of controlling a tension levelling equipment for preventing the slipping motions of the strip product with respect to bridle roll means when passing therethrough, which comprises the steps of measuring a current tension rendered upon the extension of strip at the both input and output sides of either of the input and output bridle roll means, and controlling the engaging torques of the slipping clutches in such a manner that a current slipping motion produced between the extension of strip and the bridle roll means may be nullified or eliminated according to the result of measurement of tensions.

By the provision of such an advantageous construction as noted above, there may be attained the following effect according to the present invention.

That is, when applying in practice the improved process of controlling the tension levelling equipment embodying the present invention, it can effectively remove all the defects in the surface of a strip product caused from the slipping motions as encountered during the passing through the tension leveler, thus contributing a substantial improvement in the surface conditions and quality of the strip product, accordingly.

Additional features and advantages of the invention will now become more apparent to those skilled in the art upon consideration of the following detailed description of a preferred embodiment exemplifying the best mode of carrying out the invention as presently perceived. The detailed description refers particularly to the accompanying drawings, in which like parts are designated at like reference numerals.

DETAILED DESCRIPTION OF A PREFERRED EMBODIMENT

Figure 1:
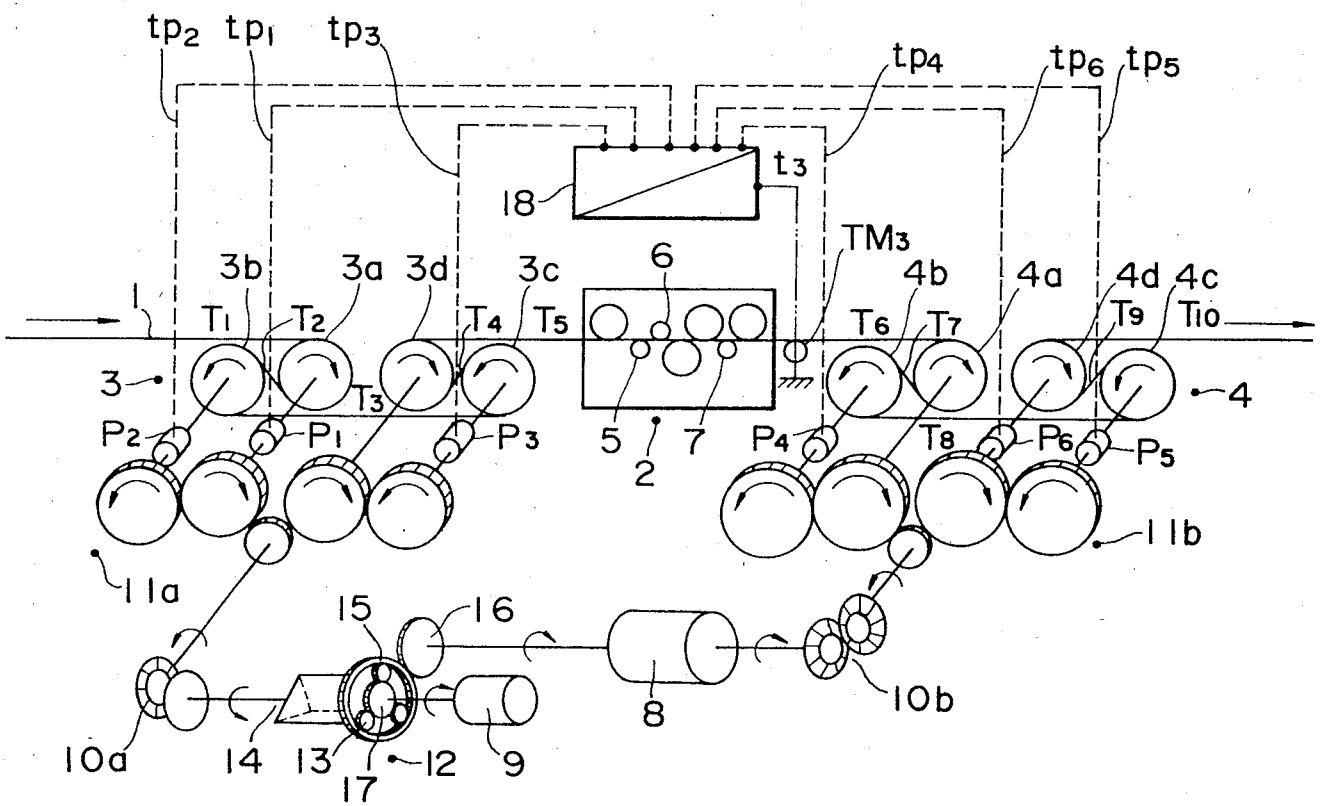
FIG. 1 is a schematic general view showing the general construction of a typical conventional tension levelling equipment.
Figure 2:
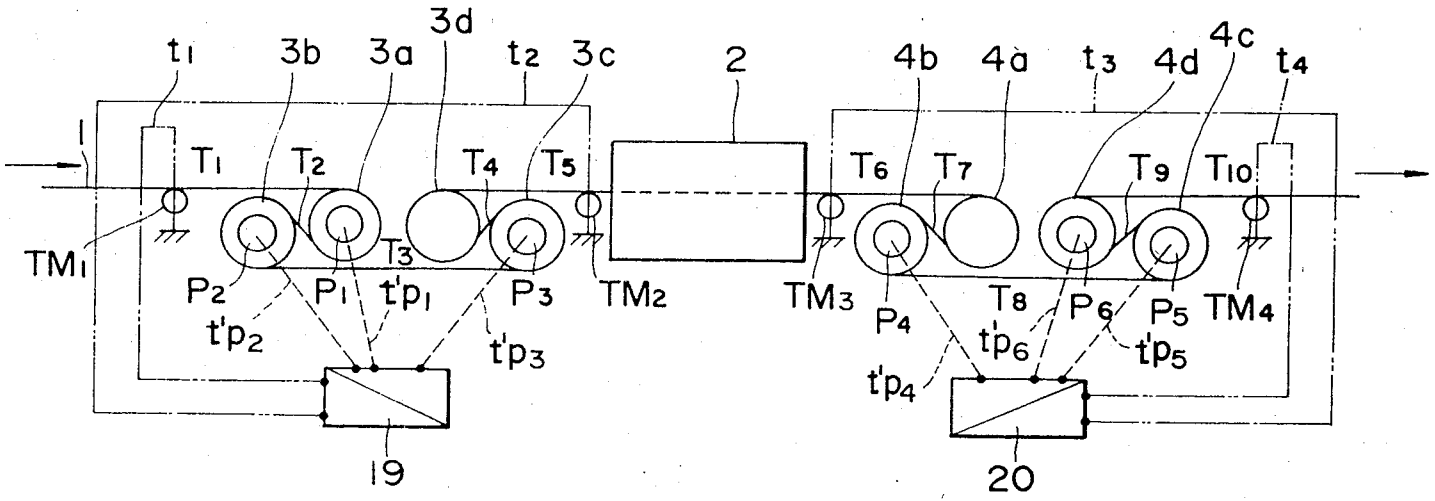
FIG. 2 is a similar schematic view particularly showing, by way of a preferred embodiment, the general construction of a tension leveller control device according to the invention.

The present invention will now be explained in concrete terms by way of a preferred embodiment thereof as adapted in practice to the control of a tension levelling equipment for removing distortions existing in the strip product while passing therethrough. Referring now to FIG. 2, there is shown the general construction of a tension leveler controlling device in practice of the improved process of preventing all possible slipping motions between the bridle units and the strip product according to the present invention, and in which like reference numerals designate like parts as in FIG. 1 and the detailed description for such like and overlapped parts will be omitted for the avoidance of a verbosity. While there is omitted the driving system in FIG. 2, the construction shown may, for instance, adopt a similar system.

As shown in FIG. 2, there are provided tension meters TM1 and TM2 which are adapted to measure a current tension in the strip product 1 on either side of the input to and the output of an input bridle unit 3, respectively, and likewise tension meters TM3 and TM4 on either side of the input to and output of an output bridle unit 4, respectively. It is arranged that the result of measurement conducted by these tension meters TM1 and TM2 are converted into electric signals t1 and t2 corresponding thereto, and then inputted into an arithmetic operation processor 19 in circuit, while the like signals of measurement t3 and t4 from the tension meters TM3 and TM4 are inputted to another arithmetic operation processor 20, so that the processing of these signals may be conducted in accordance with the relative equations thereto to be described later, respectively. Then, torques $T_{qp1}$ through $T_{qp6}$ in powder clutches P1, P2, P3 and P4, P5, P6, which are slipping clutches employed in the input and output bridle units 3 and 4, are controlled according to output signals $t'p_1$ through $t'p_6$ from the arithmetic operation processors 19, 20, following a current fluctuations in tensions of strip product so that a current quantity of slipping between the both bridle units 3, 4 and the strip product 1 may constantly turn to be nullified or eliminated completely.

Reviewing more specifically, assuming factors of torque distribution of the group of rolls belonging to the input and output bridle units 3 and 4 being $A=(T_5/T_1)^{\frac{1}{4}}$ $(A \geqq 1)$; $B=(T_6/T_{10})^{\frac{1}{4}}$ $(B \geqq 1)$, the following relationship is given; that is, $$T_4=T_5/A;\ T_3=T_5/A^2;\ T_2=T_5/A^3;\ T_1=T_5/A^4;$$

$T_6=T_5+\alpha$ ($\alpha$ is a torque corresponding to a bend loss and frictional loss throughout the levelling mill 2); and $$T_7=T_6/B;\ T_8=T_6/B^2;\ T_9=T_6/B^3;\ T_{10}=T_6/B^4.$$

Now, when converting the above equations (1) through (3) and (4) through (6) by substituting the factors of distribution A and B, the equation (1) will be made:

$$\begin{aligned} T_{qp1} &= (T_2 - T_1)\cdot D/2\cdot K = D/2\cdot K\cdot T_1(T_2/T_1 - 1) \\ &= D/2\cdot K\cdot T_5/A^4\cdot(A-1) \\ &= C\cdot T_5\cdot 1/A^4\cdot(A-1) \end{aligned} \quad (1)'$$

where, $D/2{\cdot}K=C$ (constant)

Likewise, taking other equations to be converted, as follows;

$$T_{qp2}=C{\cdot}T_5{\cdot}1/A^3{\cdot}(A-1) \quad (2)'$$

$$T_{qp3}=C{\cdot}T_5{\cdot}1/A^2{\cdot}(A-1) \quad (3)'$$

$$T_{qp4}=C{\cdot}T_6{\cdot}1/B^2{\cdot}(B-1) \quad (4)'$$

$$T_{qp5}=C{\cdot}T_6{\cdot}1/B^3{\cdot}(B-1) \quad (5)'$$

$$T_{qp6}=C{\cdot}T_6{\cdot}1/B^4{\cdot}(B-1) \quad (6)'$$

Consequently, it is now feasible in practice that each of the slipping clutches $P_1$ through $P_6$ can be controlled positively in accordance with an actual tensions during the operation on the basis of the measurement of the values of $T_1$, $T_5$, $T_6$, $T_{10}$, accordingly.

While the present invention has been described in detail by way of one preferred embodiment thereof it is practiced in the tension leveling mill having the typical roll arrangement, it is to be understood that the present invention is not intended to be restricted to the details of the specific constructions shown in the preferred embodiment, but to contrary, the present invention can of course be adapted in the tension leveler incorporating other roll arrangement to an equal advantageous effect in accordance with the foregoing teachings without any restriction thereto and without departing from the spirit and scope of the invention.

It is also to be understood that the appended claims are intended to cover all of such generic and specific features particular to the invention as disclosed herein and all statements relating to the scope of the invention, which as a matter of language might be said to fall thereunder.

What is claimed is:

1. A method of controlling a tension levelling equipment for correcting residual distortions in an extension of strip including a series of input and output bridle roll means for rendering a tension upon said extension of strip extending between the input and output sides of a levelling mill station for smoothing out the distortion, and slipping clutch means connecting said bridle roll means with driving means allowing a slipping motion therebetween, which comprises the steps of measuring a current tension rendered upon said extension of strip at the both input and output sides of either of said input and output bridle roll means, and controlling the engaging torques of said slipping clutches in such a manner that a current slipping motion produced between said extension of strip and said bridle roll means may be nullified or eliminated according to the result of measurement of tensions.

2. The method of controlling a tension levelling equipment as claimed in claim 1, wherein the engaging torques of said slipping clutches may be controlled by measuring the values of tensions $T_1$, $T_5$, $T_6$ and $T_{10}$ rendered upon said extension of strip in accordance with the relationship between a current engaging torque of each of said clutches and a current measured tension upon said strip as given by the following equations; i.e., $$T_{qp1}=C{\cdot}T_5{\cdot}1/A^4{\cdot}(A-1)$$

$$T_{qp2}=C{\cdot}T_5{\cdot}1/A^3{\cdot}(A-1)$$

$$T_{qp3}=C{\cdot}T_5{\cdot}1/A^2{\cdot}(A-1)$$

$$T_{qp4}=C{\cdot}T_6{\cdot}1/B^2{\cdot}(B-1)$$

$$T_{qp5}=C{\cdot}T_5{\cdot}1/B^3{\cdot}(B-1)$$

$$T_{qp6}=C{\cdot}T_6{\cdot}1/B^4{\cdot}(B-1)$$

and with the relationship, as follows; i.e., $$A=(T_5/T_1)^{\frac{1}{4}}(A \geqq 1)$$

$$B=(T_6/T_{10})^{\frac{1}{4}}(B \geqq 1)$$

where, $T_{qp1} \sim T_{qp6}$ represents a value of torque of a powder clutch; $T_1$, $T_5$, $T_6$, $T_{10}$ represents a measuring value of each slipping tension; $C$ (constant)$=D/2{\cdot}K$; D represents a diameter of each roll; and K represents a ratio of reduction gears.

* * * * *